United States Patent [19]

McKinnon et al.

[11] 4,262,490

[45] Apr. 21, 1981

[54] SELECTIVELY MOUNTABLE COLD CONTROL DEVICE

[76] Inventors: Eugene T. McKinnon, 16536 Chattanooga Pl., Pacific Palisades, Calif. 90272; Alvin S. Drutz, 11613 Clover Ave., Los Angeles, Calif. 90066

[21] Appl. No.: 51,800

[22] Filed: Jun. 25, 1979

[51] Int. Cl.[3] ..... F25B 49/00; H01H 37/04

[52] U.S. Cl. ..... 62/132; 337/380

[58] Field of Search ..... 200/275; 337/380; 62/132

[56] References Cited

U.S. PATENT DOCUMENTS

| | | | |
|---|---|---|---|
| 3,410,972 | 11/1968 | Tyler et al. | 200/275 |
| 3,601,742 | 8/1971 | Baker | 337/380 |
| 3,633,142 | 1/1972 | Bracht | 337/380 X |
| 3,752,900 | 8/1973 | Harrison et al. | 337/380 X |

*Primary Examiner*—Lloyd L. King
*Attorney, Agent, or Firm*—Cislo & O'Reilly

[57] ABSTRACT

A selectively mountable cold control device of the type utilized by servicemen for effectuating temporary repairs wherein the device employs alternative mounting means. In the first instance, where the cold control service is to be of a temporary nature, a pair of suction cup mounting members are utilized so as to retain the cold control device in operative relationship with the appliance with which it is used. Alternatively, where the replacement is to be of a permanent or quasipermanent nature, a singular grappling hook mounting member is utilized instead of the suction cup members. The housing of the cold control device is so configured so as to allow selection of either mode of mounting the cold control device with refrigerators, coolers and similar such appliances.

10 Claims, 7 Drawing Figures

SELECTIVELY MOUNTABLE COLD CONTROL DEVICE

BACKGROUND OF THE INVENTION

Refrigeration repair and servicemen are confronted with great difficulties in servicing refrigeration appliances because of the large number of manufactured devices and the various peculiar requirements of each of the devices and the plurality of equipment component failures that could result in any breakdown.

Usually and ordinarily, one of the main sources of breakdown in a refrigeration appliance is that coupled with the temperature regulator. The temperature regulator or thermostat will frequently need replacement on a periodic basis, but the serviceman cannot possibly stock each manufacturer's temperature control or regulator.

When a serviceman makes a call, it is necessary, because of possible deterioration of the contents being refrigerated, that the appliance be put into operation, even on a temporary basis, as quickly as possible. Operation on a jury-rigged basis is superior to no operation at all.

Thus, the cold control or the like device of this invention is directed to providing cold control regulation on a permanent or temporary basis, so as to maintain the refrigeration appliance in continuous operation. Where it is desired to utilize the device of the invention in a temporary fashion, the device is secured to the refrigeration appliance by means of temporary mounting means comprising, for example, releaseable suction cups so that once the proper temperature control device is obtained from the manufacturer or other sources, the permanent replacement can then be made.

In other instances where manufacture of the replacement regulator is no longer being made, the device of the invention may be permanently or quasi-permanently secured to the appliance without detracting from the overall appearance of the refrigeration appliance and not giving the appearance of a jury-rigged repair.

Thus, the cold control or like device of the invention provides a cold control or temperature regulator for a myriad of refrigeration appliances, and does so on a temporary or permanent basis wherein the device is esthetic in appearance and is easily adaptable to one of two modes of installation.

OBJECTS AND SUMMARY OF THE INVENTION

It is an object of the invention to provide a cold control or like device for selective temporary or permanent installation.

It is another object of the invention to provide a cold control or the like device wherein the housing member of the same is adapted to provide a selective one of two modes of mounting the device.

It is another, even still further more specific object of the invention to provide a cold control or the like device wherein the device may be mounted in temporary and releasable fashion as by means of suction cups.

It is another, even more further specific object of the invention to provide a cold control or the like device which may be mounted for temporary purposes, and wherein the device is esthetically pleasant in appearance, is lightweight, and is relatively easily manufactured.

It is still another, more important specific object of the invention to provide a cold control or the like device which employs a cabinet, or housing, wherein, in one instance, the device is adapted for temporary suction cup installation, and wherein, in another instance, the removal of an esthetically pleasant appearing plug member allows for reception of a permanent grappling hooklike member for quasi-permanent securement of the cold control device.

It is another, even more specific object of the invention to provide a housing for a cold control device wherein the housing member employs alternative mounting or securement means for mounting the device or securing same on a refrigeration appliance.

It is still another, even more specific further object of the invention to provide a cold control device wherein a housing member of the cold control device is versatile in allowing selective mode of affixing said device in cooperative relationship with a refrigeration appliance with which the cold control device is to be used.

Generally, in an exemplary embodiment, the device of the invention pertains to a cold control or the like device for selective temporary or permanent installation employing thin-walled housing defined by at least front and sidewalls. The front wall has an open bore adapted to permit disposition of a temperature regulator shaft therethrough. A pair of spaced mounting members is secured within the housing in juxtaposition to the open bore for selectively mounting the device in temporary and releasable fashion. A temperature regulator is secured within the housing and has a shaft projecting through the open bore and carries a dial knob on the end thereof. The housing also has a plugged aperture communicating the exterior surface of the front wall of the housing into the interior of the housing, and wherein an internally extending boss is provided thereabout for alternatively carrying a singular mounting member for alternately mounting the cold control device.

These and other objects will become apparent from the hereinafter following drawings taken in conjunction with the commentary.

DESCRIPTION OF THE BEST EMBODIMENTS CONTEMPLATED

Figure 1:
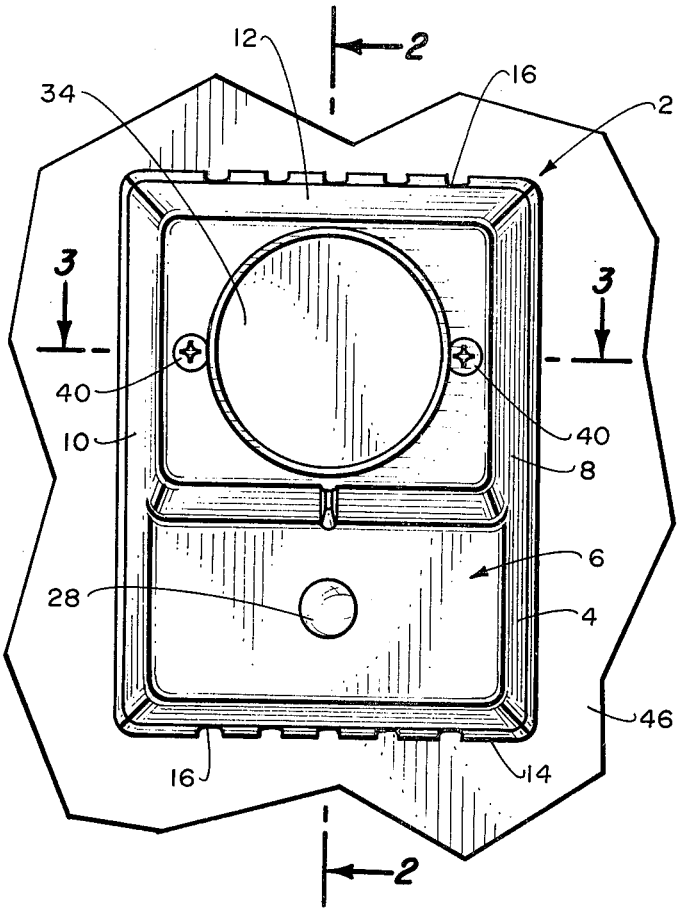
FIG. 1 is a front view of the cold control device of the invention.
Figure 2:
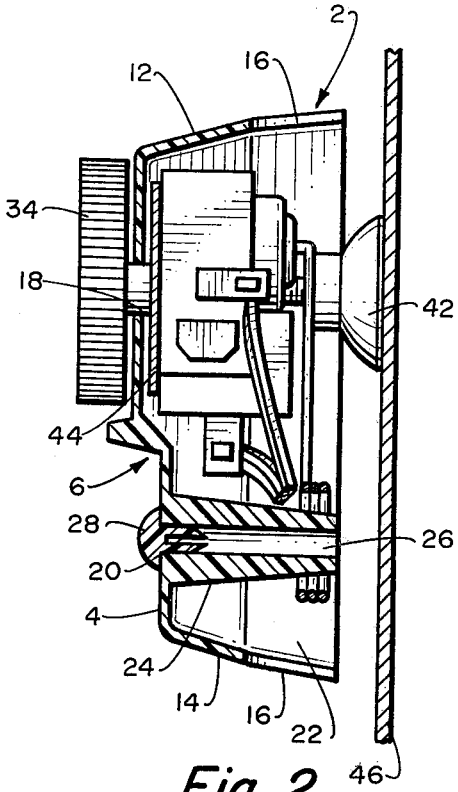
FIG. 2 is a view taken along the line 2—2 of FIG. 1.
Figure 3:
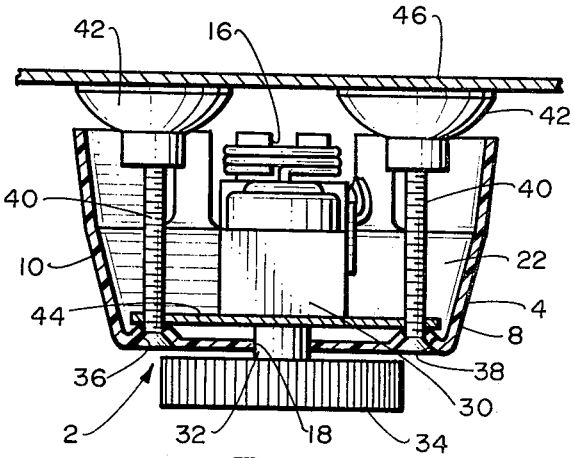
FIG. 3 is a view taken along the line 3—3 of FIG. 1.

Referring to the figures of drawings wherein like numerals of reference designate like elements throughout, and referring specifically to FIGS. 1–4, inclusive, there is illustrated one embodiment of the cold control device of this invention.

The cold control device 2 comprises a thin-walled housing member 4, made up of at least front wall 6, sidewalls 8 and 10, and top and bottom walls 12 and 14, respectively, wherein said top and bottom walls 12 and 14 are provided with cutout slots 16 in order to allow for heat dissipation, air circulation and to provide some reduction in weight to the cold control device 2.

In this particular instance, the housing member 4 is molded of suitable plastic, though other suitable materials would suffice. The front wall 6 is provided with a first upper aperture or bore 18 sufficient in size to allow disposition therethrough of a regulator shaft or the like, as will be seen hereinafter.

The lower portion of front wall 6 is provided with a second smaller bore 20 communicating the exterior surface of front wall 6 to the interior 22 defined by housing member 4, wherein there is provided about the through bore 20 an inwardly extending boss 24 having a central communication or passage 26 for purposes that will become apparent with regard to the alternative securing embodiment of the invention. Suffice to say, that for the present time, the through bore 20 and a portion of passageway 26 carries a plug 28 of split-shaft design, frictionally retained in bore 20 and a portion of passageway 26 and being esthetically pleasing in appearance so as not to have an open bore or hole perceivable when the device 2 is in use.

Contained within the chamber 22 defined by housing 4 is temperature regulator means 30 having shaft 32 extending through bore 18 and carrying on the end thereof dial knob 34 for rotational movement of the shaft 32, as is conventionally found in temperature regulator or thermostat devices.

The upper portion of front wall 6 is provided with two through bores 36 and 38 and having disposed therethrough threaded bolts 40, each carrying on the ends thereof a mounting means such as suction cups 42, in this instance, made of rubber or the like, which are threadably retained on the ends of bolts 40 and wherein the suction cups 42 may be threaded onto the ends of bolts 40 in varying degrees so as to dispose the device 2 a selective increment from the wall of the refrigeration appliance or the like with which it is used.

The through bolts 40 also mount a bracket member 44 to which, in turn, is secured the temperature regulator mechanism 30.

The lead wire connections and the like from temperature regulator or thermostat 30 have been left off for purposes of clarity, but is should be understood that wire conduit leads from the temperature regulator would be placed through, for example, the slots 16 so as to be operatively connected to the appliance with which the device is utilized.

Figure 4:
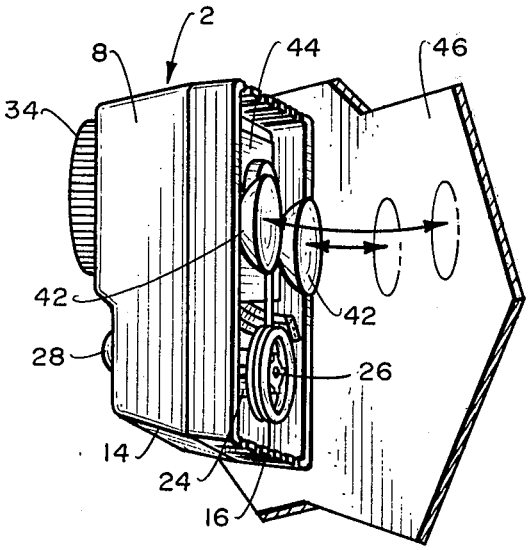
FIG. 4 is a perspective view of the device of FIG. 1 illustrating one mode of installation of the cold control device of the invention.

In utilization of the device 2, illustrated in FIGS. 1–4, inclusive, once the determination is made to affix same in a temporary and releasable fashion by means of suction cups 42 to the wall 46, for example, of a refrigeration appliance, the suction cups 42 are moistened with water or a surfactant-like solution for better adhesion and the device 2 placed into disposition, as shown by the arrows in FIG. 4, whereby the device 2 is adequately secured to the refrigeration appliance with which the device 2 is to be utilized in a temporary manner until such time as a replacement cold control device or the like can be obtained for replacement. The lead wires from the cold control may then be connected to the appliance and proper operation thereof restored. Alternatively, of course, the lead wires may be secured first and then the device 2 put into mounting position, as heretofore described.

Figure 5:
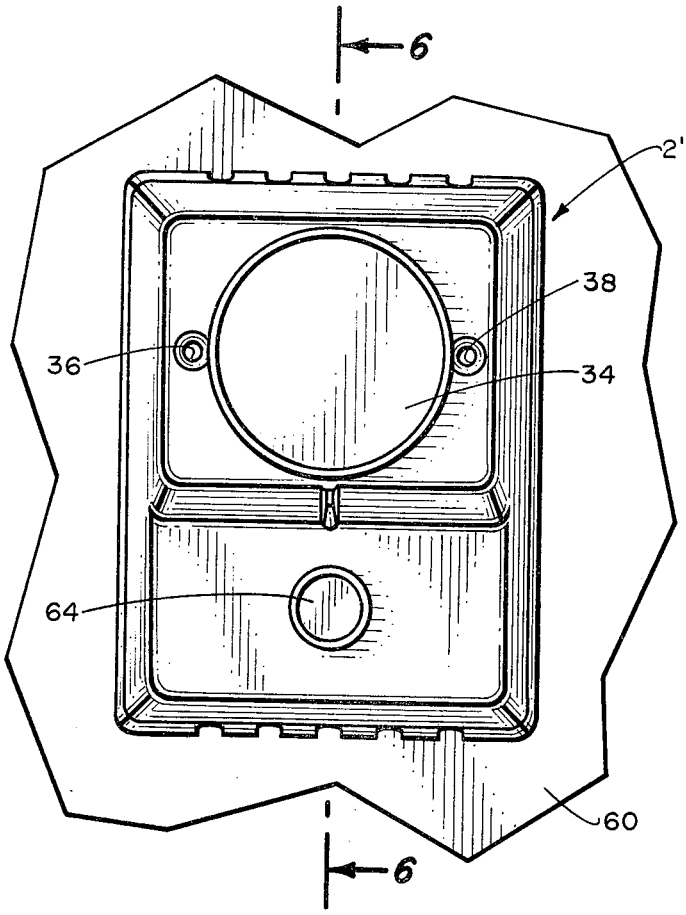
FIG. 5 is a front view of the device of the invention, but illustrating an alternative mode of mounting the same.
Figure 6:
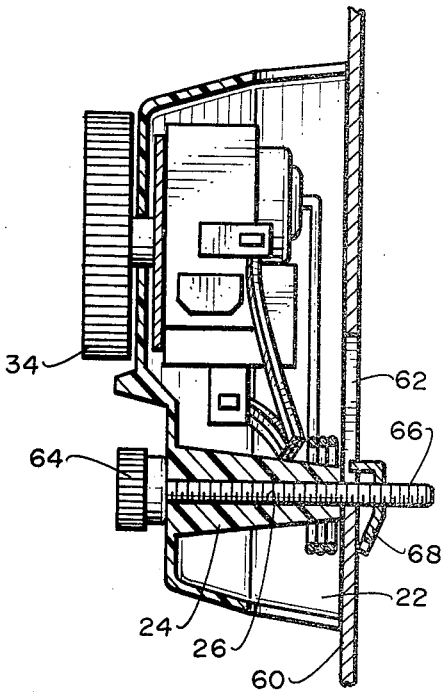
FIG. 6 is a view taken along the line 6—6 of FIG. 5.
Figure 7:
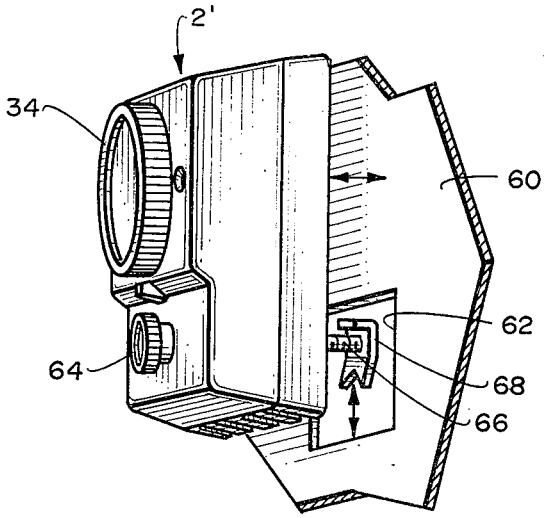
FIG. 7 is a fragmented, perspective view illustrating the means of mounting the alternative embodiment of the invention as illustrated in FIG. 5.

Referring now to FIGS. 5–7, inclusive, an alternative mode of mounting the device 2 is illustrated.

In the alternative mode of mounting device all components of the device 2 previously described, and as shown in FIGS. 1–4, inclusive, are the same. The only exception to the device 2 already described which has not been alluded to is a permanent-type, grappling hook-like, fastening member which provides the securement in a permanent or quasi-permanent mode, and which will now be more fully described.

Where a permanent affixing of the device 2' is desired and wherein in certain of the refrigeration appliance wall structure 60, a cutout or mounting slot 62 is available, the button member 28 is removed as are the suction cups 42 from the device 2 illustrated in FIGS. 1–4 of the drawings. A grappling hook-like mounting member comprising a knob 64 secured to a threaded bolt 66 having a grapple-like affixing member 68 threadably mounted, as shown in the drawings, is disposed within the passageway or bore 26 of boss 24, as best seen in FIG. 6 of the drawings.

In the alternative illustrated in FIGS. 5–7, inclusive, the device 2' is, in all particulars, the same as the device 2 described and illustrated in FIGS. 1–4, inclusive, again with the lead wires removed for purposes of clarity, and with the exception of the removal of the button member 28 and the disposition of the alternative mounting means, as best seen in FIG. 6. It will also be noted that the suction cup members, since they are not needed, may be removed as they are then unnecessary, not being required.

In the 2' device, the grappling hook member is positioned as shown in FIG. 7 and moved upwardly or downwardly within the slot 62 and, thereafter, the knob 64 rotated so as to cause the grappling hook member 68 to move toward the interior of the device 2' until such time as it encounters the abutting interior wall of appliance wall 60, so that secure, rigid positioning of the device 2' is obtained with regard to the appliance with which the device 2' is used.

Those of ordinary skill in the art will, of course, recognize that, while the device of the invention has been described with some particularity with regard to materials of construction and specific design features, various alternatives will at once suggest themselves, and all such alternatives and modifications are intended to be covered by the appended claims.

We claim:

1. A cold control or the like device for selective temporary or permanent installation comprising the combination: a thin-walled housing defined by at least front and sidewalls, said front wall having an open bore adapted to permit disposition of a temperature regulator shaft therethrough; a pair of spaced mounting means, each secured within said housing in juxtaposition to said open bore for selectively mounting said device in temporary and releaseable fashion; a temperature regulator secured within said housing and having a shaft projecting through said open bore and carrying a dial knob on the end thereof; and a plugged aperture communicating the exterior surface of said front wall into the interior of said housing and having an internally extending boss thereabout adapted to alternatively carry a singular mounting member for alternatively mounting said device.

2. The cold control device in accordance with claim 1 wherein said spaced mounting means are adjustable away from and toward the plane defined by said sidewalls.

3. The cold control device in accordance with claim 2 including top and bottom walls integral with said other front and sidewalls and wherein said mounting means comprises suction cups.

4. The cold control device in accordance with claim 3 wherein said suction cups are retained on threaded bolt members which mount said temperature regulator within said housing, and wherein said walls are of molded plastic.

5. The cold control device in accordance with claim 4 wherein said top and bottom walls are provided with slot vents.

6. The cold control device in accordance with claim 5 including a releasably retained plastic plug member carried in said plug aperture.

7. The cold control device in accordance with claim 1 including a singular mounting means comprising a grappling hook-like securing member for frictional, mechanical retention on the wall surface of a refrigeration appliance or the like.

8. The cold control device in accordance with claim 7 wherein said grappling hook-like device comprises a threaded bolt member having a knob at the end thereof, and wherein a threadably mounted grappling hook-like element is threadably disposed on said bolt.

9. The cold control device in accordance with claim 6 wherein said dial knob is of sufficient size to overlie and cover said open bore.

10. The cold control device in accordance with claim 9 wherein said threaded bolts carrying said suction cups mount said temperature regulator within said housing.

* * * * *